US006287047B1

(12) United States Patent
Dufresne

(10) Patent No.: US 6,287,047 B1
(45) Date of Patent: Sep. 11, 2001

(54) ROADWAY WATER RAMP APPARATUS

(76) Inventor: Peter Dufresne, 3842 W. Buchanan St., Phoenix, AZ (US) 85009

( * ) Notice: Subject to any disclaimer, the term of this patent is extended or adjusted under 35 U.S.C. 154(b) by 0 days.

(21) Appl. No.: 09/351,246

(22) Filed: Jul. 12, 1999

(51) Int. Cl.[7] ..... E01F 11/00; F16L 3/00; F16L 11/00

(52) U.S. Cl. ..... 404/15; 138/106; 138/109; 138/110

(58) Field of Search ..... 138/105, 106, 138/109, 110; 404/15, 16; 14/69.5; D13/155

(56) References Cited

U.S. PATENT DOCUMENTS

| | | | | |
|---|---|---|---|---|
| D. 336,524 | * | 6/1993 | White et al. | D25/102 |
| D. 415,471 | * | 10/1999 | Henry | D13/155 |
| D. 418,818 | * | 1/2000 | Henry | D13/155 |
| 1,736,932 | | 11/1929 | Lalonde . | |
| 2,166,516 | * | 7/1939 | Bainbridge . | |
| 3,357,370 | * | 12/1967 | Walkey . | |
| 3,888,186 | * | 6/1975 | Jentzsch et al. | 104/275 |
| 4,067,258 | * | 1/1978 | Valeri | 104/275 |
| 4,374,530 | | 2/1983 | Walling . | |
| 4,858,680 | * | 8/1989 | Byrne | 165/55 |
| 5,095,822 | * | 3/1992 | Martin | 104/275 |
| 5,267,367 | | 12/1993 | Wegmann, Jr. . | |
| 5,333,919 | * | 8/1994 | Nerenberg | 285/363 |
| 5,353,843 | | 10/1994 | Hoag . | |
| 5,385,431 | | 1/1995 | Topf, Jr. . | |
| 5,755,527 | | 5/1998 | Dufresne . | |
| 6,039,319 | * | 3/2000 | Coonce et al. | 277/314 |
| 6,045,033 | * | 4/2000 | Zimmerly | 228/189 |
| 6,067,681 | * | 5/2000 | Zeinstra et al. | 14/69.5 |

FOREIGN PATENT DOCUMENTS

| | | |
|---|---|---|
| 104986 | 12/1938 | (AU) . |
| 530667 | 12/1940 | (GB) . |
| 1327659 | 8/1973 | (GB) . |

* cited by examiner

*Primary Examiner*—Thomas B. Will
*Assistant Examiner*—Gary S Hartmann
(74) *Attorney, Agent, or Firm*—H. Gordon Shields

(57) ABSTRACT

Ramp apparatus conveying water across a thoroughfare includes a block having a pair of ramp elements and liquid carrying bores extending through the block. A pair of manifolds are connected to the ends of the block. The apparatus is designed to be disposed across the thoroughfare or roadway, and accordingly has a relatively low profile for ease of traffic problems as traffic moves over the ramp apparatus. At the same time, the apparatus is able to carry a substantial amount of fluid or liquid, such as water, from one side of the thoroughfare to the other side. A plurality of blocks may be secured together to span roadways of any length.

3 Claims, 2 Drawing Sheets

ROADWAY WATER RAMP APPARATUS

BACKGROUND OF THE INVENTION

1. Field of the Invention

This invention relates to transporting water across a road and, more particularly, to a modular ramp apparatus with integral water carrying chambers therein.

2. Description of the Prior Art

U.S. Pat. No. 1,736,923 (LaLonde) discloses a hose coupling and a hose for supplying both water and oxygen for firemen. The hose comprises a pair of concentric hoses with water being conveyed in the inner hose and oxygen conveyed between the outer and inner hoses. The particular coupling disclosed allows lengths of the concentric hoses to be connected together.

U.S. Pat. No. 4,374,530 (Walling) discloses flexible tubing used in well production. The tubing includes a flexible external shell and a resilient core within the shell, with a plurality of conduits within the resilient material. The tubing is segmented so as to be easily wound about a reel for transporting to and from a well site. The configuration of the apparatus is generally rectangular.

U.S. Pat. No. 5,267,367 (Wegmann, Jr.) discloses a safety ramp for protecting hoses in conduits. The ramp includes a channel running lengthwise in which is disposed a hose.

U.S. Pat. 5,353,843 (Hoag) discloses a protective jacket in which abose may be disposed. The protective jacket is segmented, to allow the jacket, and the hose disposed therein, to curve or bend, as required.

U.S. Pat. No. 5,385,431 (Topf, Jr.) discloses a flow conduit for transporting water across a road. Water flows into a metal pipe configured with two sloping sides and a flat top and bottom, with the pipe disposed across a road. Connector elements on opposite ends of the pipe allow hoses to be connected to the pipe.

U.S. Pat. No. 5,755,527 (Dufresne), the inventor of which is the inventor of the present invention, discloses ramp and piping for transporting water across a road. The piping comprises a plurality of conduits with headers at opposite ends of the conduits for connecting to hoses. Ramps are connected to the conduits to facilitate traffic across the conduits. Australian Patent 104,986 discloses a hose bridge for protecting a hose.

British Patent 530,667 also discloses a hose bridge. The two hose bridges are structurally different, but both provide the fiction of protecting a hose.

British Patent 1,327,659 discloses protective bumpers disposed about a flexible hose for protecting the hose from traffic.

Of the above discussed patents, the Wegmann '367, the Hoag '843, and the Australian and British '667 patent all deal with the protection of hoses from traffic. The Lalonde patent is concerned with the flow of two fluids, water and oxygen, in a hose, and the Walling '530 patent is concerned with flexible tubing used in wells. The British '659 patent is concerned with the protection of a flexible hose in situations where there is relative movement in the hoses or lines, such as hydraulic brake fluid lines, etc. The Topf, Jr. and Dufresne patents deal with the same subject matter as the present invention, namely the flow of water across a road with minimum problems with traffic and with maximum water flow without the problems of hoses and of water surges of hoses over which vehicular traffic moves.

The apparatus of the present invention is concerned with the transmission of a fluid, such as water, across a street or thoroughfare during construction, and the like, where traffic moves along the street or thoroughfare. The present apparatus includes a modular unit including an integral ramp and fluid carrying elements and which protects both the fluid as it is being transported, and vehicular traffic moving along the street or thoroughfare. The apparatus includes modules of extruded piping or conduits made of rubber or the like with male and female connections on opposite ends for connecting a plurality of like modules so that the length of piping or conduits may vary according to the width of the street or thoroughfare.

SUMMARY OF THE INVENTION

The invention described and claimed herein comprises a modular element with a double ramp and integral fluid carrying elements extending the length of the module. The term "double ramp"simply means that one side of the apparatus includes an up ramp and the opposite side includes a down ramp for traffic moving in both directions. The center section of the apparatus, or the portion between the two ramps, includes conduits through which liquid, such as water, flows. The ends of the ramp elements include male and female connectors for connecting a plurality of modules together to form a single fluid carrying unit. Manifolds are connected to opposite ends of the unit for hoses to provide a flow of fluid input and output. The ramp elements may be made in virtually any length, or a plurality of the ramp elements may be appropriately secured together to provide a ramp of a desired length.

Among the objects of the present invention are the following:

- To provide new and useful apparatus for transporting water across a thoroughfare;
- To provide new and useful apparatus including an integral ramp and fluid carrying element for transporting a fluid;
- To provide a new and useful extruded fluid carrying module;
- To provide a new and useful modular apparatus for transporting water across a roadway;
- To provide manifolds for connecting to fluid carrying modules;
- To provide new and useful element having fluid carrying chambers and at least a single additional chamber in which nonfluid material may be disposed;
- To provide new and useful fluid carrying element including a double ramp to be disposed across a thoroughfare; and
- To provide new and useful ramp apparatus having an integral fluid carrying chamber therein.

DESCRIPTION OF THE PREFERRED EMBODIMENT

Figure 1:
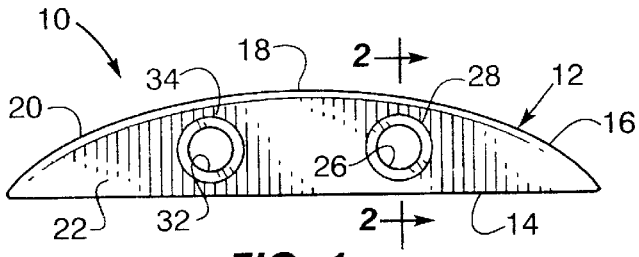
FIG. 1 is an end view of the apparatus of the present invention.
Figure 2:
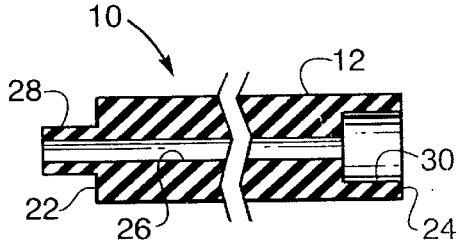
FIG. 2 is a view in partial section taken generally along line 2—2 of FIG. 1.

FIG. 1 is an end view of a roadway water ramp apparatus or module 10 of the present invention. FIG. 2 is a view in partial section of the apparatus 10 of FIG. 1 taken generally along line 2—2 of FIG. 1. For the following discussion, reference will primarily be made to FIGS. 1 and 2.

The roadway water ramp apparatus 10 includes a block 12 made preferably of extrudable material, such as rubber, or the like. The extrusion comprises a block 12 which has a generally flat bottom 14 which is disposed on a roadway surface, or the like, and a sloping side ramp surface 16 which extends from the bottom 14 to a generally flat top surface 18. The flat surface 18 then extends to another sloping ramp surface 20 which generally has the same slope as that of the surface 16. The sloping surface 20 extends from the top surface 18 to the bottom surface 14. The block 12 also includes a pair of end surfaces 22 and 24. On the end surface 22, there are a pair of male connector elements 28 and 34 which are disposed about a pair of fluid transporting bores 26 and 32.

On the end 24, there are a pair of female connector elements, of which a connector bore element 30 is shown in FIG. 2 at the end 24. The bore is a counter-bore with respect to the bore 26 which extends longitudinally through the block 12. In the extruding process, the bores 26 and 32 are integral with the block 12, and the male and female connector portions are then appropriately milled or machined, or in other appropriate manners, cut from the block 12.

It will be understood that the extrusions may be made in any length and cut to appropriate lengths, as desired. Moreover, with male connectors at one end and female connectors at the opposite end, modules may be connected together to provide a fluid transmission element of any desired or appropriate length, according to the width of the roadway the modules may span.

Figure 3:
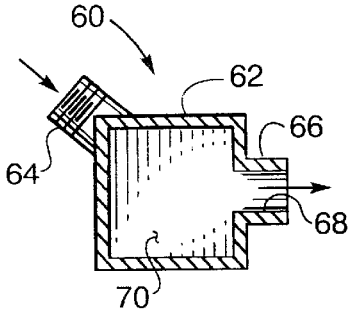
FIG. 3 is a view in partial section of a portion of the apparatus of the present invention.

FIG. 3 is a view in partial section of a manifold 60 which may be connected to an end of a module 10, for providing a flow of liquid, such as water, through a module or a plurality of connected modules. A similar manifold will be placed at the opposite end of the module or modules to be connected to a hose for transporting the fluid away from the module or modules.

The manifold 60 comprises a generally rectangular enclosure 62 with a hose connecter 64 appropriately connected to the container 62. A fluid, such as water, is transmitted to the manifold 60, by a hose connected to the connector 64. Within the container 62 is an interior chamber 70 which receives the fluid, such as water. The fluid then flows our of the container through the connector elements to a ramp apparatus module 10 to which the manifold is connected. A pair of connectors 66 extend outwardly to mate with the connector elements 28 and 34 to supply fluid to the conduits 26 and 32. Only a single connector 66 is shown in FIG. 3. However, it will be understood that there is another connector generally parallel to the connector 66 for connection to the connector 34 shown in FIG. 1.

The connector 66 includes an internal bore 68 which receives the male connector element 26. A second manifold, (see FIG. 9, and discussion thereof, below) substantially identical to the manifold 60, except for the size of its connector elements, is also used. The second manifold includes male connector elements for extending into the female connector bore 30 at the opposite end of the apparatus 10 from the connector 28. Thus, the two manifolds, an input manifold 60 and an output manifold, are required for fluid transmitted through a single water ramp module 10, or through a plurality of modules 10 connected together.

Figure 4:
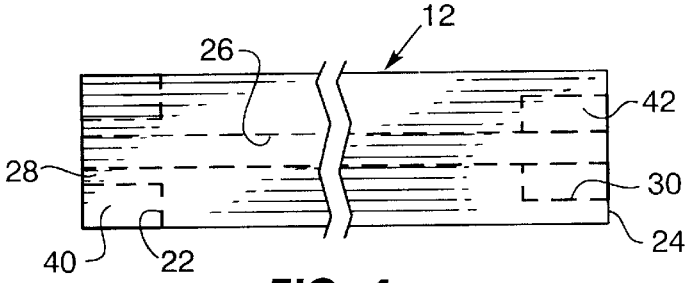
FIG. 4 is a side schematic representation of the apparatus of the present invention prior to cutting operations for the finished product.

FIG. 4 illustrates the process of taking a block 12 and converting it to a module. As indicated above, the block 12 is extruded with at least a pair of bores 26 and 32 extending therethrough. Then, the material indicated by reference numeral 40 in FIG. 4 is removed to define the end 22 and a pair of male connector elements 28 and at one end. At the other end of the block 12 there is a pair of enlarged counter bores or recesses cut into the end 24 to comprise the pair of female connector elements, such as the connector element 30. For making the connector element 30, material indicated by reference numeral 42 in FIG. 4 is removed.

It will be understood that the extrusions for the blocks 12 are actually taken from a single extrusion and cut into appropriate or desired lengths. The lengths of the blocks are then appropriately cut, as illustrated in FIG. 4, to provide the fluid transmission modules 10 which may be connected together to span a roadway of virtually any width. Furthermore, it will be understood that a block 12 may be dimensioned so as to have as many fluid carrying bores as desired.

Figure 5:
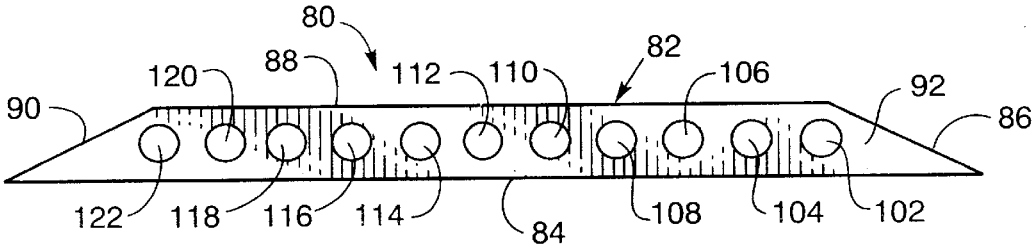
FIG. 5 is a front view of an alternate embodiment of the apparatus of the present invention.

FIG. 5 comprises a front view of an alternate embodiment 80 of the present invention. The alternate embodiment module 80 comprises a block 82 made of extruded material, such as rubber, as discussed above for the block 12. The block 82 includes a bottom surface 84, a first ramp surface 86, a top surface 88, and a second ramp surface 90. The ramp surfaces 86 and 90 extend upwardly and inwardly from the bottom surface 84 to the top surface 88. The top surface 88 is generally flat. The corners where the ramp surfaces, which comprise side surfaces, connect to the bottom and top surfaces may be appropriately rounded or radiused to minimize problems as traffic passes over a module. The block also includes a pair of ends, of which an end 92 is shown in FIG. 5.

Eleven bores are shown extending through the block 82. The bores include bores 102, 104, 106, 108, 110, 112, 114, 116, 118, 120, and 122. The bores are connected appropriately to a pair of manifolds, such as the manifold 60, illustrated above in FIG. 3. An appropriate manifold is connected to each end of the module.

The manifolds connected to the module 80 would, of course, include the appropriate number of connectors for connecting with the eleven bores 102 . . . 122.

Figure 6:
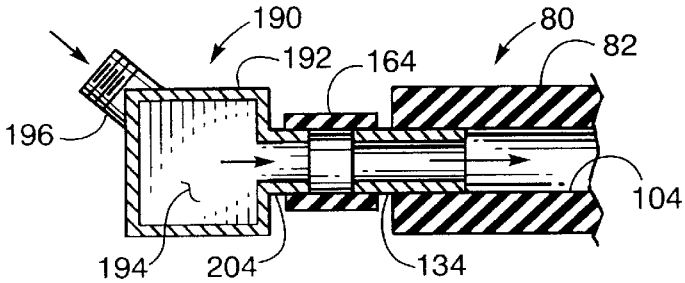
FIG. 6 is a side view in partial section illustrating the apparatus of FIG. 5.

FIG. 6 is a view in partial section taken through the module 80 at the bore 104 and showing a manifold 190 secured to the module 80. The manifold 190 includes a container 192 defining a liquid, such as water, receiving chamber 194 therein. A hose connector 196 is appropriately secured to the container 192. Eleven elements extend outwardly from the connector 192 for connection to the bores 102 . . . 122 of the module 80. In FIG. 6, a connector element 204 is shown extending outwardly from the container 192.

The module 80 also requires a plurality of connector insert elements which extend into the respective bores. A connector element insert 134 is shown in FIG. 6 extending into the bore 104. For connecting the elements 204 and 134 is a short connector sleeve 164. Thus, a plurality of connector sleeves, such as the connector sleeve 164, are used to connect the connector elements of the manifold 190 and the module 80 to allow fluid, such as water, to flow from the manifold 190 to the module 80.

It will be understood that a similar manifold and connector elements, etc., are connected to the opposite end of the module 80 to take care of the fluid flow out of the module 80. Relatively large arrows indicated the direction of the fluid flow in both FIGS. 3 and 6.

Figure 7:
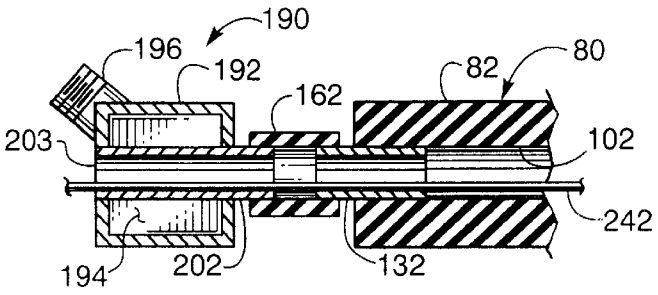
FIG. 7 is a side view in partial section illustrating an alternate embodiment of the apparatus of FIG. 6.

FIG. 7 is a side view in partial section showing an alternate embodiment of the manifold 190 used with the module 80. The manifold 190 may include a connector 202 which extends completely or fully through the container 192, and the interior of the connector 202 is thus isolated from the interior chamber 194 through which it extends. On the exterior of the container 192 there is an opening 203 for the connector element 202. The opening 203 is on a rear wall of the manifold.

The connector element 202 extends outwardly from the container 192, in a fashion similar to that of the connector element 204 illustrated in FIG. 6.

A connector element 132 extends into the bore 102 of the block 82 and a connector element 162 is used to connect the connectors 132 and 202 together. A conductor, or conductors, 242 may extend through the connector 202 of the manifold 190, through the connector 162 and through the conductor 132 into the bore 132 and thence through the block 82, and through any additional modules which may be connected serially together. The conductor(s) 242 may be a telephone cable, or the like, as desired.

Referring again to FIG. 5, the eleven bores 102 . . . 122 may be connected to a pair of manifolds 190 which may include all fluid carrying connectors to one or more modules 80 to provide a flow of water across the roadway or, in the alternative, one or more of the bores 102 . . . 122 may be used to carry conductors, such as telephone conductors, or even power cables, across a roadway through a modified manifold 190 as illustrated in FIG. 7.

Figure 8:
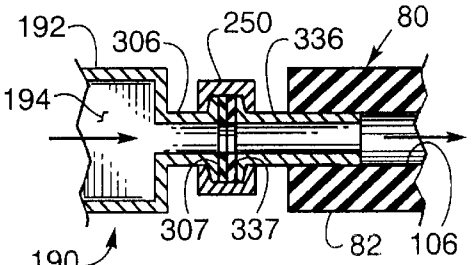
FIG. 8 is a fragmentary side view in partial section illustrating an alternate coupling embodiment for the apparatus of the present invention.

FIG. 8 illustrates an alternate embodiment of connector elements usable with the apparatus of the present invention. The block 82 of the module 80 is shown in partial section, with the bore 106 illustrated therein. The container 192 of the manifold is also illustrated, with a connector element 306 extending outwardly from the manifold 190. A connector element 336 is shown extending into the bore 106. The connector element 336 includes an outer flange to which is secured a gasket 337. The flange 336 and its gasket 337 are generally circular. The connector element 306 also includes a circular outer flange to which is secured a gasket 307. The gaskets 307 and 337 are urged into contact with each other in a sealing relationship by a clamp 250. Thus, there is a sealing relationship between the manifold 190 and the module 80 to provide for the flow therethrough of a liquid, such as water, from the chamber 194 of the manifold 190, through the connector 306 and its mating connector 336 and the bore 106 of the block 82 of the module 80.

Figure 9:
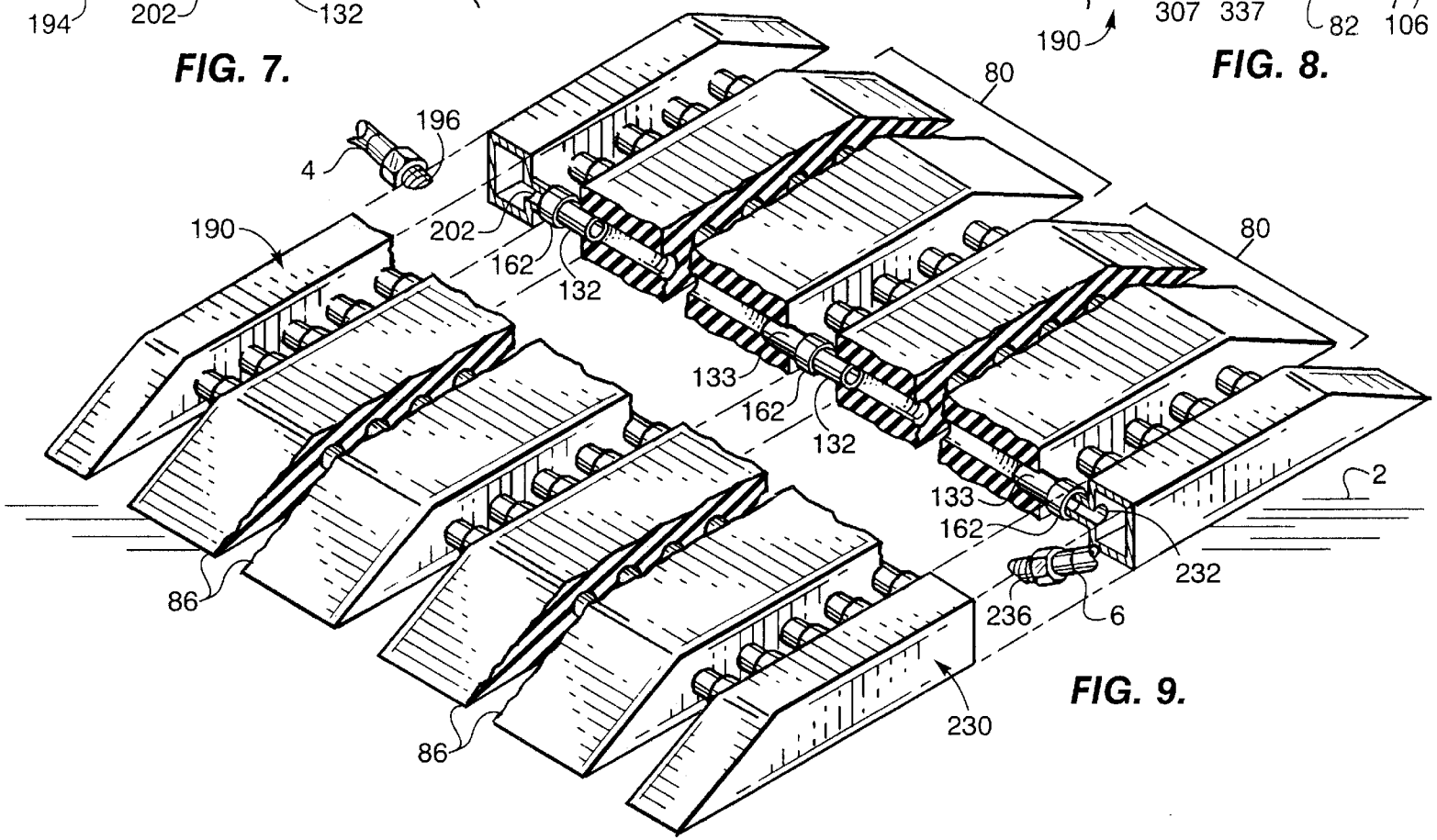
FIG. 9 is a perspective view, partially broken away, of the apparatus of the present invention in its use environment.

FIG. 9 is a perspective representation of a pair of roadway ramp modules 80 connected together and disposed on a roadway 2. The Figure is partially broken away, or sectioned. The roadway ramp modules 80 are connected together by connector sleeves 162 and their respective elements. An input manifold 190 is shown connected to an input hose 4 at the hose connector 196. A connector element 202 is connected by connector sleeve 162 to an connector insert 132 of the module 80

An output connector insert 133 is shown connected by a connector sleeve 162 to an input connector insert 132 of the second module 80. The output insert connector 133 is then shown connected by a sleeve 162 to a connector element 232 of an output manifold 230. An output hose 6 is in turn connected to an output hose connector 236 of the manifold 230. The ramp sides 86 of the modules 80 are also shown in FIG. 9.

The relative sizes of the various elements of FIG. 9 have been greatly exaggerated for illustrative purposes. It will be understood that the modules 80 are typically about 1½ to 2 inches tall or high and they may be any appropriate length, such as four feet, six feet, eight feet, etc. Similarly, the manifolds are appropriately sized to provide full flow of fluid for the various modules in accordance with the fluid demand to be conveyed across the roadway or thoroughfare 2.

With the ramp modules made of rubber, or of an appropriate elastomeric material, there will be a degree of flexibility inherent in each module. Thus, the module will be able to adapt to the crown of roadways and will give slightly as vehicles run over them. However, with several fluid carrying bores in each module, the flow of water, etc., will be substantially undiminished as traffic moves along the roadway and over the ramp modules.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A method of making an apparatus for conveying a liquid across a thoroughfare comprising in combination the steps of:

providing a block of material including a pair of sloping ramp sides;

removing material from one end of the block to provide a male connector;

removing material from the other end of the block to provide a female connector, providing at least a single bore extending through the block and through the male and female connectors;

providing a pair of manifolds;

connecting one manifold of the pair of manifolds to the male connector; and connecting the one manifold of the pair of manifolds to the female connector.

2. The method of claim 1 which includes the further steps of providing a plurality of bores extending through the block through which the liquid may flow through the block and providing a male connector at one end of the block and a female connector at the other end of the block for each bore of the plurality of bores.

3. The method of claim 2 in which the step of providing a block includes the further steps of extruding the block and cutting the extruded block into desired lengths, each of which lengths comprises a ramp module and each of which modules includes male connectors at one end and female connectors at the other end of each length.

* * * * *